US010508375B2

(12) United States Patent
Zattin et al.

(10) Patent No.: US 10,508,375 B2
(45) Date of Patent: Dec. 17, 2019

(54) METHOD FOR OPERATING A WASHING APPLIANCE AND WASHING APPLIANCE

(71) Applicant: Electrolux Appliances Aktiebolag, Stockholm (SE)

(72) Inventors: Andrea Zattin, Solesino (IT); Federico Del Maschio, Pordenone (IT); Elena Pesavento, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 236 days.

(21) Appl. No.: 15/320,768

(22) PCT Filed: Jun. 24, 2014

(86) PCT No.: PCT/EP2014/063239
§ 371 (c)(1),
(2) Date: Dec. 21, 2016

(87) PCT Pub. No.: WO2015/197109
PCT Pub. Date: Dec. 30, 2015

(65) Prior Publication Data

US 2017/0145612 A1 May 25, 2017

(51) Int. Cl.
*D06F 33/02* (2006.01)
*D06F 39/08* (2006.01)
(Continued)

(52) U.S. Cl.
CPC ..... *D06F 33/02* (2013.01); *A47L 15/0021* (2013.01); *D06F 39/005* (2013.01);
(Continued)

(58) Field of Classification Search
CPC ..... D06F 39/005; D06F 33/02; D06F 39/045; D06F 39/083; D06F 2202/02;
(Continued)

(56) References Cited

U.S. PATENT DOCUMENTS 2,626,620 A * 1/1953 Smith ..... B08B 3/00 134/103.1
3,359,760 A * 12/1967 Toma ..... D06F 33/02 307/141
(Continued)

FOREIGN PATENT DOCUMENTS

DE 19534431 A1 3/1997
DE 10145601 A1 10/2002
(Continued)

OTHER PUBLICATIONS

International Search Report in corresponding International Application No. PCT/EP2014/063239, dated Feb. 25, 2015.
(Continued)

*Primary Examiner* — Benjamin L Osterhout
(74) *Attorney, Agent, or Firm* — RatnerPrestia

(57) ABSTRACT

A method for operating a laundry washing appliance having a washing chamber to wash laundry the method includes selecting a default washing temperature and/or a washing cycle having a default washing temperature; supplying a detergent to the washing chamber; and determining a type of the detergent which has been added. When the detergent is of a first type, then the method includes comparing the default washing temperature with a threshold temperature and if the default washing temperature is higher than the threshold temperature, then emitting a warning signal and/or changing said default washing temperature.

24 Claims, 6 Drawing Sheets

(51) Int. Cl.
*D06F 39/04* (2006.01)
*D06F 39/00* (2006.01)
*A47L 15/00* (2006.01)

(52) U.S. Cl.
CPC ..... *D06F 39/045* (2013.01); *D06F 39/083* (2013.01); *A47L 2401/026* (2013.01); *A47L 2401/10* (2013.01); *A47L 2401/12* (2013.01); *A47L 2401/30* (2013.01); *A47L 2501/26* (2013.01); *A47L 2501/30* (2013.01); *D06F 2202/02* (2013.01); *D06F 2202/04* (2013.01); *D06F 2202/12* (2013.01); *D06F 2204/04* (2013.01); *D06F 2204/10* (2013.01); *D06F 2216/00* (2013.01)

(58) Field of Classification Search
CPC ..... D06F 2202/12; D06F 2204/10; D06F 2216/00; D06F 2202/04; D06F 2204/04
See application file for complete search history.

(56) References Cited

U.S. PATENT DOCUMENTS

| | | | | |
|---|---|---|---|---|
| 5,134,867 | A | 8/1992 | Kiuchi et al. | |
| 2003/0019253 | A1* | 1/2003 | Lorenz | D06F 39/003 68/13 R |
| 2010/0095465 | A1 | 4/2010 | Kim et al. | |
| 2010/0281625 | A1* | 11/2010 | Oh | D06F 35/006 8/137 |
| 2010/0306927 | A1* | 12/2010 | Oh | D06F 33/02 8/137 |
| 2011/0224834 | A1* | 9/2011 | Schleuthner | D06F 33/02 700/278 |
| 2014/0157526 | A1* | 6/2014 | Larmo | D06F 39/003 8/137 |
| 2014/0259441 | A1* | 9/2014 | Fulmer | D06F 39/004 8/137 |
| 2014/0259448 | A1* | 9/2014 | Alexander | D06F 33/02 8/137 |

FOREIGN PATENT DOCUMENTS

| | | | |
|---|---|---|---|
| DE | 102012208618 | A1 | 11/2013 |
| EP | 0393311 | A1 | 10/1990 |
| EP | 1688529 | A1 | 8/2006 |
| EP | 1707663 | A1 | 10/2006 |
| EP | 2113599 | A1 | 11/2009 |
| EP | 2183423 | A1 | 5/2010 |
| EP | 2243416 | A1 | 10/2010 |
| JP | H07124374 | A | 5/1995 |
| JP | H08112484 | A | 5/1996 |
| JP | 2011200524 | A | 10/2011 |
| JP | 2014064791 | A | 4/2014 |

OTHER PUBLICATIONS

International Search Report in corresponding International Application No. PCT/EP2014/063215, dated Mar. 6, 2015.
International Search Report in corresponding International Application No. PCT/EP2014/063237, dated Mar. 12, 2015.
Database WPI, Week Jun. 9, 2011, Thomson Scientific, London, GB; AN 2011-M70965, XP002736410, =& JP 2011 200525 A (Matsushita Denki Sangyo KK), Oct. 13, 2011, abstract, paragraphs [0015], [0039] -[0071]; figures.

* cited by examiner

METHOD FOR OPERATING A WASHING APPLIANCE AND WASHING APPLIANCE

TECHNICAL FIELD

The present invention is relative to a method for operating a washing appliance, such as a washing machine or a dishwasher, preventing the user, or at least acknowledging the latter, from setting inconsistent or performance detrimental parameters while selecting the desired washing cycle in the appliance. The invention also relates to a washing appliance operating according to such a method.

BACKGROUND

In modern washing appliances, the user is free to set parameters in the washing appliance regarding the washing conditions of the goods to be washed.

These parameters can be "direct" parameters, such as the temperature of the water, or duration of the main wash phase or the number of rinsing phases, or "indirect" parameters, such as the selection of a delicate or intensive washing, which in turn set automatically a plurality of direct parameters.

However, there are many cases in which the parameters set by the user are not the optimal ones for the type of goods to be washed or are inconsistent with the desired goods' treatment. Some of these parameters are for example the temperature of the washing cycle, which is the maximum temperature during the main washing cycle, or the presence or absence of additional rinsing cycles with respect to a default number.

As an example of a possible mismatch between user's set parameters and optimal parameters, the combined selection of a wool program and of a the temperature of the washing cycle equal to 90° C., definitely shows an inconsistency between the type of goods (woolen products) and the selected temperature, which will cause felting or shirking of the clothes.

Some washing programs or washing appliances are designed in such a way to prevent the user to set inconsistent parameters. For example, a wool specific program generally does not allow the user to select a washing temperature above 40° C. in order to avoid any damages to the clothes. A washing machine programmed to correct the maximum spinning speed if the load inside the washing chamber is unbalanced and too high noise is expected if the set speed is used is also known.

In other known appliances, the length of the washing cycles can be adapted to the real load condition of a washing machine, so that the cycles can be longer or shorter depending on the real loading condition.

Many types of detergents to be used in the washing appliances are available nowadays.

The detergents can be classified in different groups, depending on their physical state: there are detergents in powder form, detergents in liquid or gel form and detergents in tablet or pod form (also named as tabs, liquid tabs, monodoses). The detergent in tablets is realized by compressed powder, with or without an outer plastic membrane, which can also be further sub-divided in 2-in-1 detergent tablets, 3-in-1 tablets, 5-in-1 tablets, etc., while in the detergent in pods the liquid detergent is always enveloped in a plastic membrane which dissolves in water.

Applicant has noticed that liquid detergents, regardless whether they are traditional (or conventional) or in pods, are not recommended at high temperature (e.g. higher than 40° C.) due to the partial deactivation at such temperatures of some of the components in which they are realized. On the other hand, Applicant has found that detergents in powder form do not suffer from this inconvenient and generally their washing performances increase with temperature.

This recommendation to avoid use of liquid detergents with higher temperatures may appear rather unjustified to the user who has generally the belief that the higher the temperature (without taking into account the fabric composition which might need care and limitations), the better the washing results are going to be.

Applicant has also realized that the contrast between the user's belief and the detergent supplier recommendations using liquid detergent at high washing temperatures could make the user believe that a deficiency is present in the washing apparatus itself, which is, in his/her opinion, not performing properly.

In order to solve this problem, Applicant has understood that a modification in the washing appliance has to be made in order to take some action if there is a discrepancy between the type of detergent used, which works properly in a certain temperature range, and the temperature of the washing cycles when the washing program has been selected, in particular when the selected temperature is higher than the range in which the detergent has the best cleaning efficiency.

SUMMARY OF SELECTED INVENTIVE ASPECTS

According to a first aspect, the invention relates to a method for operating a laundry washing appliance having a washing chamber to wash laundry, said method including:

- Selecting a default washing temperature and/or a washing program having a default washing temperature;
- supplying a detergent to the washing chamber;
- Determining a type of said detergent which has been supplied;

Characterized in that, in case said detergent is of a first type, the method includes

- Comparing said default washing temperature with a threshold temperature; and
- If said default washing temperature is higher than said threshold temperature, emitting a warning signal and/or changing said default washing temperature.

According to a second aspect, the invention relates to a laundry washing appliance, said washing appliance including:

- a washing chamber to wash laundry apt to rotate around an axis;
- a control panel including one or more selection devices apt to select a default washing temperature and/or a washing program having a default washing temperature to wash laundry inside said washing chamber;
- a sensor capable of determining a type of detergent supplied in said washing chamber;

Wherein said laundry washing appliance further includes a control unit in communication with said sensor and said control panel, said control unit being apt to check whether said default washing temperature is higher than a given threshold, and to send a warning signal and/or to change said default washing temperature if said default washing temperature is higher than said threshold.

The present invention is applicable to washing appliances, such as for example a washing machine, as well as a combined washer-dryer machine, apt to wash laundry in one or more washing cycles. Preferably, the invention is applicable to washing machines and combined washer-dryer; however the invention might be applied to dish washers as well.

The washing appliance generally includes a washing chamber where the laundry to be washed are introduced and then, after the washing cycles, removed. The washing chamber, such as a drum included in a tub, is apt to rotate around an axis. The axis can be a horizontal axis, a vertical axis or a tilted axis, in other words, the invention applies to both front loading and top loading washing appliances.

In the washing chamber, water is introduced and, during one or more of the washing cycles, also a detergent is added to the water, as described in the following.

In the washing appliance, a user can select a washing program among a plurality of possible available programs. The selection can be made preferably operating a control panel, for example by means of a push button, a touch screen, a rotating knob or any other suitable means apt to select a program from a given list. In a washing machine, such programs' list includes for example a delicate or woolen program, a cotton program, a quick-wash program, "intensive mode" program, "eco mode" program, etc.

Depending on the program selected, the maximum temperature of the water inside the washing chamber can be automatically determined by the selection of the program itself (e.g. wool program sets automatically a water temperature of 40° C.), or the user is required to input the maximum temperature, selecting the same from a list of available temperatures for the selected program. In the first option, the user may be allowed to modify the water temperature proposed by the appliance for the selected program. In the second option, several temperatures may be available, such as for example in the cotton program, where the user, after having selected the cotton program itself, is generally asked to select the maximum water temperature among a list of temperatures such as 30°, 40°, 60°, 90° etc.

Alternatively, some washing appliances "decides" the best suitable program to be used by themselves depending on the introduced goods, and the user is required to input some additional information, such as the washing temperature, or number of rinsing cycles, etc. In a preferred embodiment of the invention, the washing appliance is fully automatic and selects the program automatically as soon as goods have been introduced in the washing chamber.

In a different appliance's programming, the user is free to set any parameter of the washing of laundry, no preset value being forced by the selection of a program.

In any case, the maximum water temperature at which the laundry is subjected to during the selected washing program, regardless of whether such temperature has been automatically set when the program has been selected or it has been inputted by the user, is called in this context "default washing temperature".

In an embodiment, the user, before or after selecting the washing program and/or the washing temperature, introduces some detergent into the washing appliance, for example in a detergent drawer or detergent dispenser, or in a detergent compartment within a door of the appliance.

In a different embodiment of the invention, the washing appliance automatically introduces the detergent during the washing cycle. For example, the washing appliance may include a detergent storage tank were detergent is stored and, when the washing program is selected, either automatically or by the user, it doses the proper amount of detergent to be used during such a program. The detergent can be supplied to the washing chamber for example by means of a dedicated pump. The detergent storage tank preferably includes an amount of detergent suitable for a plurality of washing programs.

The detergent is used during the washing cycles prescribed by the selected washing program in order to properly wash the laundry inserted into the washing chamber.

It is to be understood that more than one detergent can be introduced inside either the detergent drawer or the detergent tank storage. For example, a detergent or laundry additive for the pre-wash phase can be supplied; a second detergent for the main wash and a fabric softener can be added as well. The detergent which is considered in the present invention is the detergent of the main wash phase, where the highest temperature of the whole washing program is achieved.

As already mentioned, detergents can be in powder, either traditional (or conventional) or in tablets, or in liquid or gel form, also in this case either loose or in pods (also named pouches, liquid tabs, monodoses). However, other type of detergents or fabric additives could be put in the market in the near future having different components and performances.

The detergent's type can be identified either automatically, i.e. by the appliance itself, by means for example of suitable sensor(s), or by the user which can select the type of detergent introduced using for example a memorized detergents' list or any other selector or known means present in the appliance. Also in this latter case, it is said that the washing appliance includes a "sensor" to determine the selector operated by the user to select the detergent's type.

In case the detergent type is determined automatically by the washing appliance, any method can be used. For example, the detergent type can be detected using a conductivity sensor. Such a sensor can be placed inside the washing appliance, in the washing chamber, so as to be in contact with the washing fluid when the latter is introduced in the washing chamber. Alternatively, the sensor can be placed in a recirculation circuit for the water. Moreover, two different sensors can be used, one in the washing chamber and one in the recirculation circuit.

It has been shown that different types of detergents dissolve in different time intervals (e.g. some types of detergents take longer to dissolve than others) and/or reach different threshold value of concentration. Thus, from detecting the evolution of the conductivity of the washing liquid where the detergent has been added over time, it is possible to determine the type of detergent used.

For example, the conductivity sensor can be used to determine how fast the detergent is dissolving: tabs dissolve with a different [time] Vs [conductivity] time pattern. The analysis of the conductivity in order to determine the type of detergent used is for example described in EP 2243416, EP 1707663 or DE 10145601 and they can be applied in this invention.

Alternatively, a different method is described in EP 2183423, in which the turbidity of the washing liquid is taken into consideration. Also this method can be used in the present invention.

Turbidity sensors may be optical sensors positioned in a hydraulic path of the appliance and may measure the optical transmittance of the liquid medium at a certain wavelength. While generally a stable relationship exists between transmittance and turbidity for a specific type of particles, the quality of the turbidity measurements may be a limiting factor for the accuracy. A turbidity sensor may comprise at least one light source(s), such as a light-emitting diode (LED) or similar solid-state lighting device, and at least one light-sensitive element(s), such as a phototransistor. A portion of the light emitted by the light source can then be received by the light-sensitive element after passing through the liquid medium. By comparing the radiant intensity (radiated power per unit solid angle) of the emitted light and the radiant intensity I of the received light, it is possible to deduce the transmittance of the liquid medium.

When the type of detergent has been determined, either manually (e.g. user's input) or automatically (e.g. the washing appliance includes a software and/or a sensor to determine the type of detergent used without any input from the user), it is checked whether the detergent type is of a first type (for example, liquid). The check can be performed by a control unit present in the washing appliance.

Detergents of the first type are detergents in which the temperature is a primary parameter, which means that they are detergents that are optimized for use at relatively low water temperature. In case the user selects a high washing temperature and at the same time introduces a detergent of the first type which has rather low performances at such temperature, according to the invention an action is required.

If the detergent it is not of the first type, then no action is required and the selected washing program proceed as standard, e.g. as memorized in a memory of the washing appliance. For example, if the detergent's type is of the powder one, any temperature is suitable for its proper functioning, so no further checking is performed by the appliance and the washing program can continue unchanged.

If the detergent is of the first type, then a further investigation takes place by the appliance.

First of all, it is checked whether the default washing temperature is above or below a threshold temperature. The threshold temperature depends, among others, on the detergent's type (e.g. if a detergent of the first type is a liquid detergent, then the threshold temperature is recommended to be not above 40° C., similarly if the detergent of the first type is a gel detergent, then the threshold temperature is recommended to be not above to 40° C.) and on the selected washing program. The threshold temperature does not need to be always the same for a given detergent's type; on the contrary it can change depending on the washing program selected. Therefore, for a given washing program (e.g. cotton) there can be a first threshold temperature, and for another washing program (e.g. wool) there can be a second, different, threshold temperature.

In case the default washing temperature is below the threshold temperature, then the selected washing program can continue without any change. Otherwise, i.e. in case the default washing temperature is above the threshold temperature, an action is started.

In order to avoid the inconsistency between the temperature range of efficiency of the detergent of the first type and the default temperature set by the user, three alternatives are possible according to the invention:

A. A warning message is issued by the washing appliance;

B. The default washing temperature is automatically changed by the washing appliance to a temperature below or equal to the threshold temperature;

C. As in B, but in addition the user is warned of the change, substantially in the way described in A.

In case A, the warning message can be of any type: the warning could be optic (e.g. a light blinking in the control panel) or acoustic (e.g. a beep sound is emitted), or a combination of the two. A message, such as written text, could appear for example in a display screen of the washing appliance. Alternatively, a light can start blinking. The user is free to follow the "suggestion" of the washing appliance, i.e. the user can change the default washing temperature to a lower one so that the new default temperature is lower than or equal to the threshold, or he/she can keep the original default temperature and the selected washing program continues unchanged. This warning is triggered by the issue of a warning signal by the control unit in the washing appliance.

In case B, the appliance automatically changes the default temperature of the washing water and the user is not informed of the change. Preferably, the default temperature is changed to the highest acceptable temperature for the detergent of the first type, for example the threshold temperature. The control unit therefore automatically changes the default temperature of the program.

In case C, the washing appliance emits a warning, where the warning is the same as described with reference to case A above, and changes the default temperature to the highest acceptable temperature as in case B. In addition, due to the fact that he/she has been warned of the inconsistency, preferably the user can overrule this change, and go back to the original default temperature, or he/she can accept the change made.

Preferably, in a washing appliance, case B and C are interchangeable. For example, in the same appliance two identical washing programs can be present, one with option B and the other with option C. Or, alternatively, for every washing program there is the possibility of having either option B or C.

In this way, according to the invention, if the user selects a temperature which is not proper for the type of detergent used, the detergent of the first type which is "temperature sensitive", the appliance "takes action", either informing the user of the mismatch and/or changing the temperature itself. More than one threshold can be placed, so that different detergents can be checked and controlled. The risk of inefficient washing is thus minimized.

The invention, according to the two above described aspects, may include, alternatively or in combination, one of the following characteristics.

Preferably, said changing said default washing temperature includes:

lowering said default washing temperature to a reference temperature.

More preferably, said reference temperature is identical to said threshold temperature.

As mentioned, preferably the appliance automatically lowers the temperature to the highest optimal one, which is the threshold temperature.

In a preferred embodiment, emitting a warning signal includes:

emitting a visual and/or acoustic signal indicating that the default washing temperature is too high.

Warning signals can be of any type, as known in the present field. The same warning signal already used for other warnings can be used as well, e.g. a red light start blinking when some malfunctioning occurs in the appliance.

Advantageously, after emitting said warning signal, the method includes allowing a user to modify said default washing temperature and/or said washing program.

In this case, the user is warned that the default temperature is too high and he/she cannot obtain the optimal performances from the chosen detergent, so he/she is allowed to modify the same, e.g. either modifying the default washing temperature or the washing program itself, for example choosing a different one.

Preferably, after changing said default washing temperature, the method includes:

allowing a user to modify the changed temperature.

Thus, the user in this embodiment is not "forced" to accept the change imposed by the appliance, but can go back to the default washing temperature or even set a different temperature than the original one.

Advantageously, in case said detergent is of a second type, the method includes leaving the default washing temperature and/or washing cycle unmodified.

There are some detergent's types optimized for working properly at any temperature level commonly available on commercial washing machines. For these detergent's types there is no need of having additional controls on the default temperature because, as said, any temperature will lead to good performances (neglecting other factors as the amount of dirt in the goods, the type of goods, etc.).

In a preferred embodiment, said detergent of a first type is a detergent in liquid or gel form.

The method of the invention is preferably particularly relevant when liquid or gel detergents are used. These detergents are recommended to be used at low washing temperatures.

Preferably, said detergent of the second type is a detergent in powder form.

It is known that detergents in powder form are recommended also for high washing temperatures.

In a preferred embodiment, determining the type of said detergent includes measuring the conductivity of a washing liquid present in said washing chamber.

More preferably, measuring the conductivity of the washing liquid includes:

determining the rate of change in conductivity caused by dissolution of said detergent in said washing liquid.

Alternatively or in addition, determining the type of said detergent includes:

measuring the turbidity of a washing liquid present in said washing chamber.

More preferably, it includes:

determining the rate of change in turbidity caused by dissolution of said detergent in said washing liquid.

Preferably, a combination of a turbidity measurement and a conductivity measurement is performed. Preferably, determining the type of said detergent includes:

measuring the conductivity of a washing liquid present in said washing chamber (2); and measuring the turbidity of a washing liquid present in said washing chamber (2); and determining that said detergent is a liquid or gel detergent if said conductivity is below a conductivity threshold and said turbidity is below a turbidity threshold; or determining that said detergent is a powder detergent if said conductivity is above a conductivity threshold and said turbidity is above a turbidity threshold.

The detection of the type of detergent can be carried on during the preheating and/or the early stage of the main wash phase that is after it has completely dissolved in water. Physical parameters used for this kind of detection are turbidity (cloudiness, meant as expression of the amount of light that is scattered or absorbed by the liquid; turbidity can be considered as the opposite of optical transmittance, high transmittance means low turbidity) and conductivity (meant as resistive component of electrical impedance), used synergistically. Use of combined turbidity and conductivity provides quantitative and qualitative improvement of data quality/reliability/precision if compared to use of one of these two parameters alone, since electrochemical and optical analysis give complementary points of view of the phenomenon under investigation.

Applicant has found that accurate results are obtained using the following table:

TABLE 1

| Type of detergent | Conductivity | Turbidity |
|---|---|---|
| Liquid | LOW | LOW |
| Powder | HIGH | HIGH |

where "low" and "high" have the meaning of "below threshold" and "above threshold", in this case two threshold being present, a turbidity and a conductivity threshold.

Analysis for detergent type recognition proposed here is based on difference in conductivity and turbidity signals from measures on the two types of detergents dissolved in water. Applicant has noticed that, under some conditions, turbidimetric water analysis alone could not be enough for distinguishing liquid to powder detergent; as conductimetric analysis alone. On the other hand, combination of turbidity and conductivity signals do enable to distinguish detergent type uniquely.

Alternatively, in a different preferred embodiment, determining the type of said detergent includes:

selecting the type of detergent among a list of possible detergent types.

Any other method to determine the type of detergent can be used as well, including the "manual" method, e.g. the user is selecting the type of detergent used from an available list.

Advantageously, said threshold temperature depends on said selected washing program.

Depending on the washing program, the threshold temperature can be programmed to be different. Indeed, the washing efficiency of the detergent can have different impacts on the washing result of the laundry depending on the washing program itself, so for example in some washing program a higher temperature can be tolerated because it will not excessively hinder the washing performances.

Advantageously, selecting a default washing temperature and/or a washing program having a default washing temperature includes:

Automatically selecting a washing program on the basis of one or more parameters of said laundry.

In other words, as mentioned, the selection of the washing program and/or the default washing temperature is performed automatically by the washing appliance.

Preferably, said sensor is located within said washing chamber.

Alternatively or in addition, said washing appliance includes a recirculating water circuit and said sensor is located within said circuit.

Two different types of water sensing devices can be located within the appliance. Using together both the two different sensors can improve the sensitivity of the whole system, allowing detecting different type of detergents with a high precision.

According to a preferred embodiment, said sensor is a conductivity sensor.

According to a different embodiment, or in addition to the previous one, said sensor is a turbidity sensor.

Preferably, said washing appliance is a washing machine or a dish washer or a washer-dryer.

Advantageously, the washing appliance includes a warning device connected to said control unit apt to warn a user if said default washing temperature is higher than a given threshold.

BRIEF DESCRIPTION OF THE DRAWINGS

Preferred embodiments of the present invention will be now described in greater details with reference to the attached drawings in which.

DETAILED DESCRIPTION OF A PREFERRED EMBODIMENT

Figure 1:
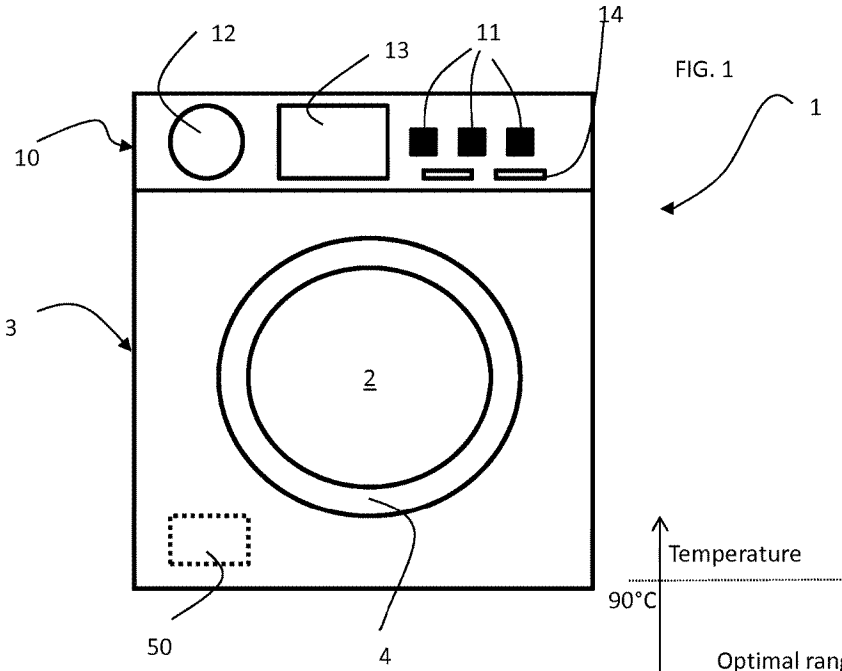
FIG. 1 is a schematic view of a washing appliance operating according to the method of aspects of the invention.

With initial reference to FIG. 1, a laundry washing appliance operating according to the method of the invention is globally indicated with 1.

The washing appliance 1, depicted here as the preferred embodiment, not limiting the scope and applicability of the invention, is a washing machine. The machine 1 includes a washing chamber 2, where goods, in this case laundry, are placed and removed. Washing chamber 2 is preferably contained in a casing 3 having an aperture closed by a door 4 pivotably mounted on the casing 3.

The washing machine 1 includes further a control panel 10 apt to be used by a user to set parameters of washing programs (e.g. temperature, number of rinsing cycles, speed of spinning, etc.) and/or to select a washing program from a given list, through suitable push buttons 11 or knobs 12. Moreover, control panel 10 includes preferably a display 13 and one or more light elements 14.

The washing machine 1 is programmed to function according to the one or more washing programs. These programs include for example a wool program, a cotton program, a quick program, etc. Each of these programs includes one or more washing cycles, these cycles being a pre-wash cycle (if needed), a main washing cycle, one or more rinsing cycles, a spinning cycle and optionally, in case of a washer-dryer, a drying phase.

Washing programs are stored for example in a memory (not depicted in the appended drawings) accessible by a control unit 50 of the appliance 1. A washing program, among the available washing programs, is selected by the user using the control panel 10. Alternatively, the program is selected automatically by the washing machine 1 after laundry has been introduced within the washing chamber 2. Moreover additional parameters, as mentioned, can be selected by the user. The user can input the type of washing program desired and/or the default washing temperature of such a program. The maximum temperature of the water during the washing program is called default washing temperature. Control unit 50 controls the washing machine 1 according to the selected program.

Figure 3:
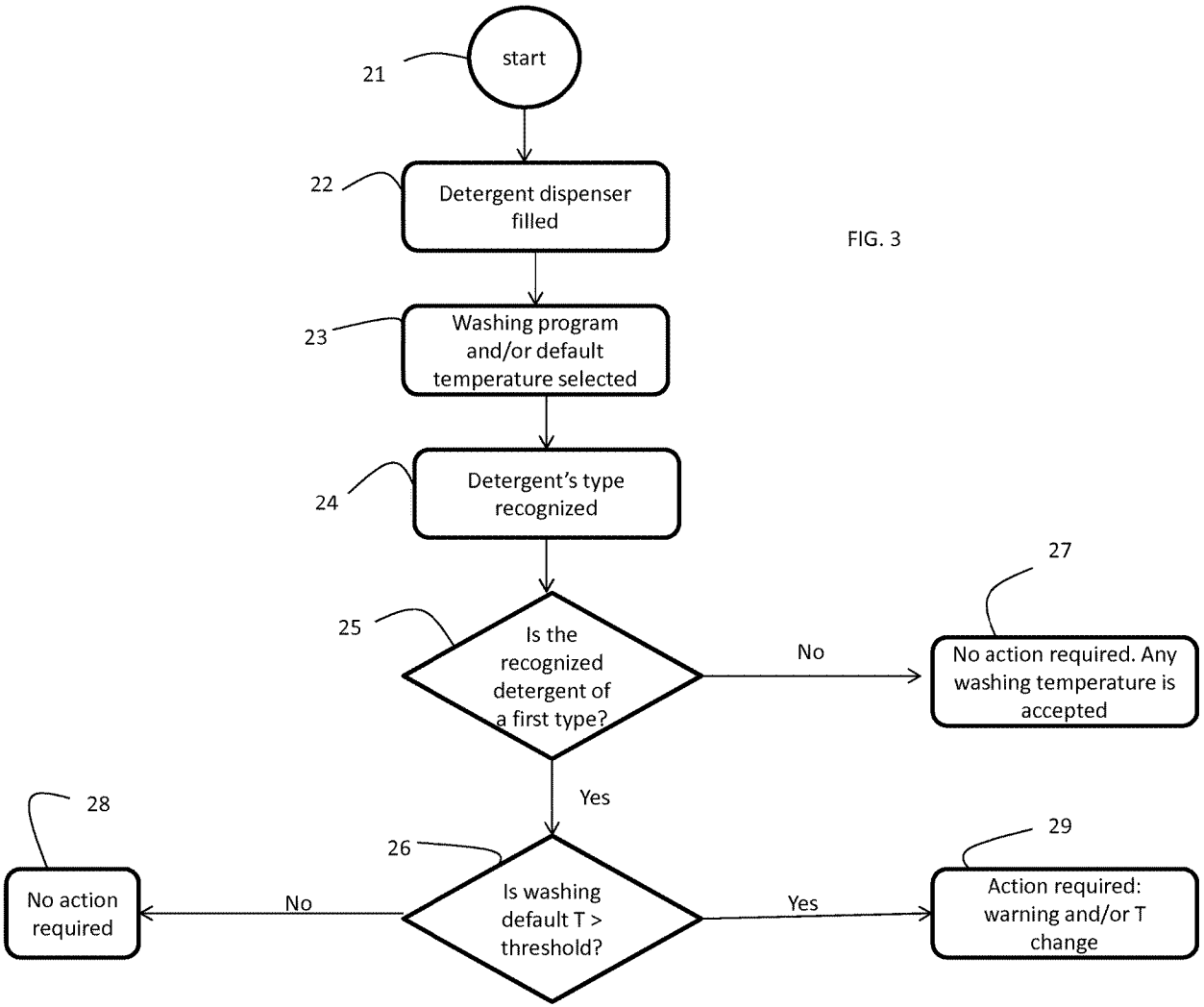
FIG. 3 is a flowchart of the method according to aspects of the invention.

This is phase 23 of the method of the invention as per FIG. 3.

The user, before or after phase 23, inserts a detergent of a given type inside the washing appliance 1, for example in a detergent dispenser or drawer (not shown in the drawings). The detergent is then flushed from the drawer and then introduced within the washing chamber. This is phase 22 of the method of the invention. Alternatively, the detergent can be supplied automatically by the appliance 1 itself as soon as the need of detergent is required during the washing program. In this case, the machine 1 includes a detergent tank (not depicted) in which the detergent is stored and, for example by means of a pump, is introduced in the washing chamber. The introduction of the detergent in the washing chamber can be made before or during the beginning of the washing program.

At the beginning of the washing cycle, which could be the main washing cycle or of the pre-wash cycle if selected, of the selected washing program, the water inlet is opened and fresh water is inserted in the washing chamber 2.

In order to determine the type of detergent introduced by the user, as required in step 24 of the method of the invention, either the user has selected the type of detergent introduced, for example inputting this information via the control panel 10, or the appliance 1 does the recognition automatically by means of one or more sensors. In the latter case, for example a conductivity sensor (not shown) can be positioned inside the washing chamber 2. Alternatively, the conductivity sensor can be located in a recirculation water circuit of the washing appliance.

In the latter case, preferably, during the filling of the washing chamber 2 with fresh water, the conductivity of the fresh water can be measured so as to obtain a fresh water conductivity reference value, or alternatively a fresh water conductivity reference value may be preset in an operating program of the appliance 1.

After or during the introduction of fresh water into the washing chamber, the detergent introduced by the user is also flushed into the washing chamber 2 or injected in the chamber by means of the pump connected to the detergent tank. After a given time, and preferably at given time intervals, the conductivity of the so obtained liquid (water and detergent mixture) is measured.

The conductivity so measured is compared with one or more thresholds and also preferably the time in which the measurements have been made is taken into account. From the above mentioned comparisons and from the time in which the measurements have been taken, the detergent's type can be determined.

Figure 4:
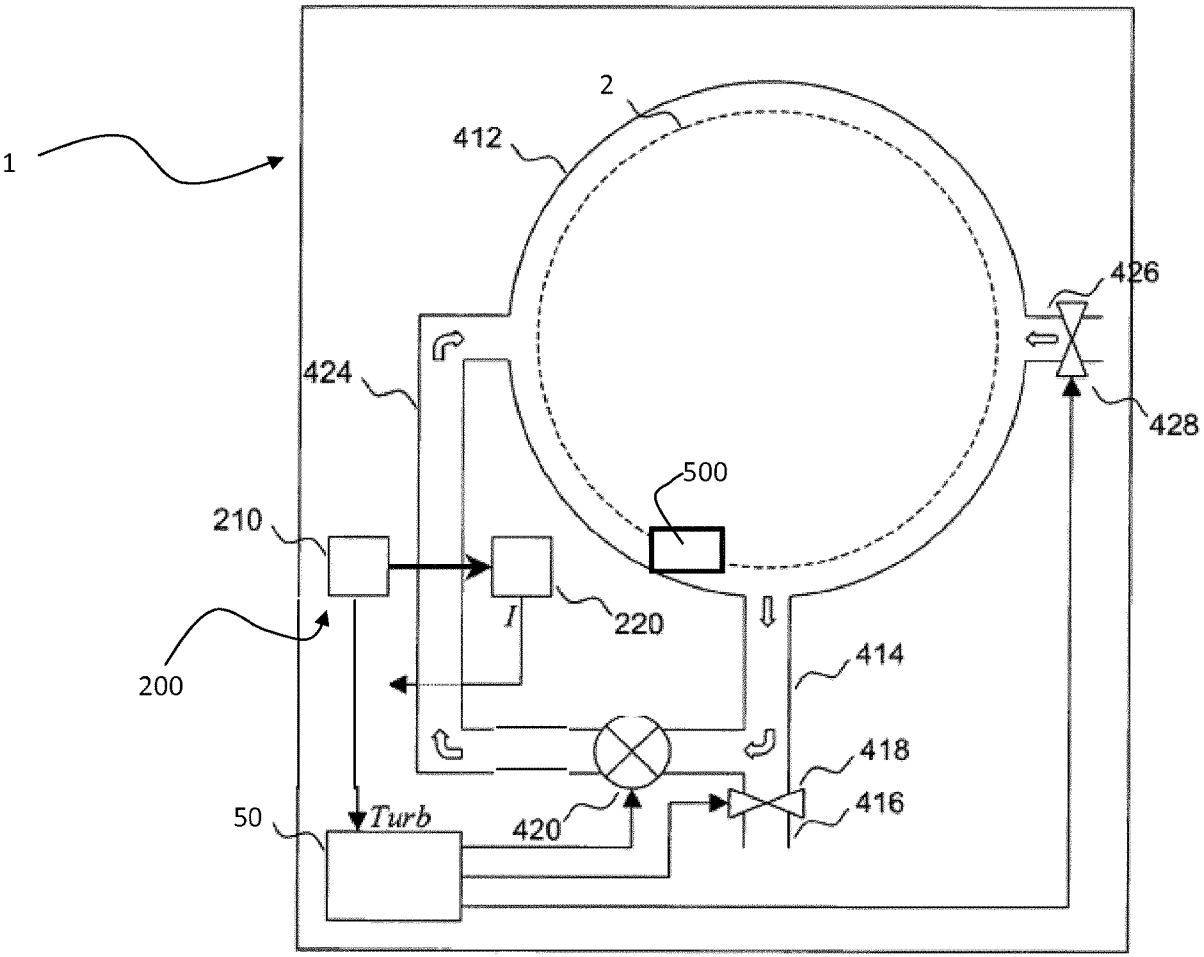
FIG. 4 is a schematic view of a washing appliance according to an embodiment of the invention.

In a different embodiment of the invention, as depicted in FIG. 4, the sensor includes a turbidity sensor 200 and a sensor of conductivity 500.

The washing chamber 2 is suspended in a basin 412 having a downward first duct 414 connected to a drain 416 via a first valve 418. During operation of the machine 400, the basin 412 generally contains an amount of washing liquid and the first valve 418 is in the closed position. Washing liquid is fed via an inlet 426 by opening a second valve 428. A pump 420 is adapted to recirculate fluid exiting the basin 412 via a second duct 424. Means for influencing the course of the washing cycle, notably the valves 418, 428 and the pump 420, are controllable by the control unit 50. In this example, the sensor 200 is provided around the second duct 424 and provides a signal indicative of the turbidity to the control unit 50.

More precisely, the sensor 200 may include a light-emitting portion 210 and a light-receiving portion 220 is provided on one side and on the opposite side of the second duct 424.

After determining the turbidity of the fluid on the basis of the emitted and received intensities, the control unit 50 determines the type of detergent used.

Advantageously, the walls of the second duct 424 are transparent to the wavelength of the light emitted by the sensor 200, at least in a segment around the sensor 200. Alternatively, apertures may be provided in the second duct 424, so that the light-emitting 210 and light-receiving portions 220 of the sensor 200 make direct contact with the washing fluid.

Furthermore, washing machine 1 includes an additional sensor 500 located within the washing chamber 2, which measures the conductivity of the washing liquor as detailed above.

According to an embodiment of the invention, the two measurements are used in the following way in order to determine the type of detergent introduced in the washing chamber 2.

Figure 5A:
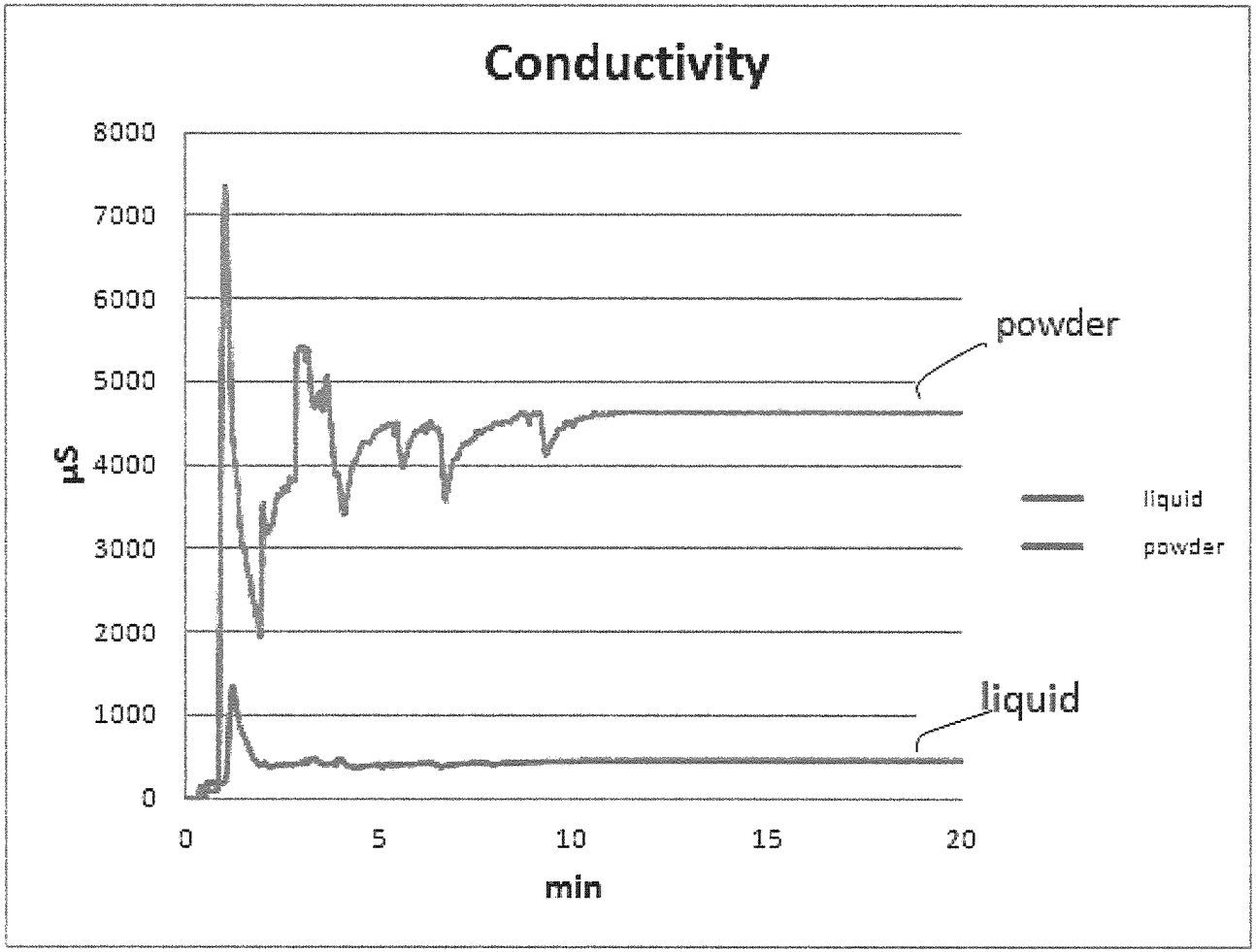
FIGS. 5*a* and 5*b* are two graphs of an embodiment of a phase of the method of the invention.
Figure 5B:
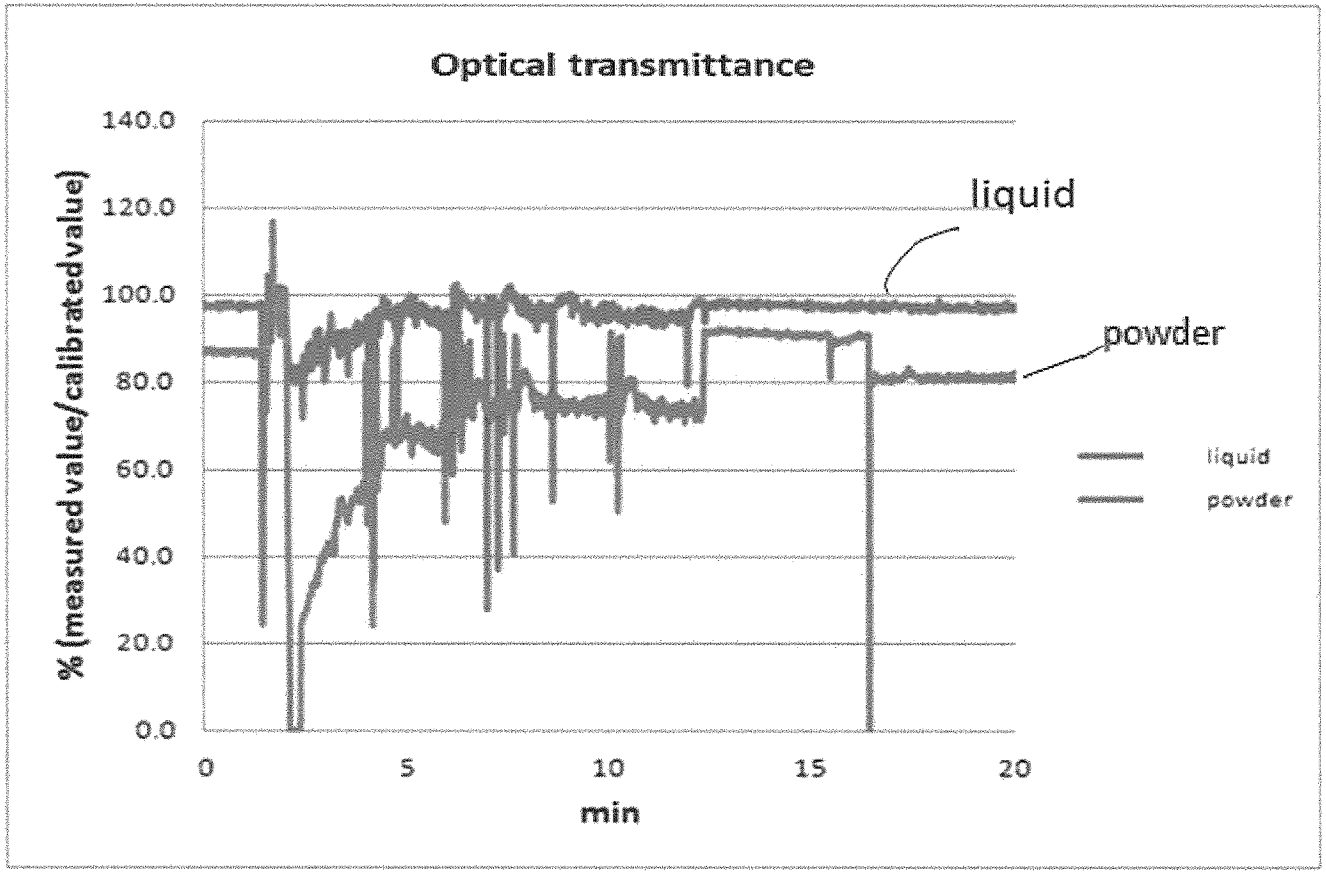

As visible in the graphs of FIGS. 5*a* and 5*b*, it is evident the large gap between signals when one or the other of the two type of detergents are used. In FIG. 5*a*, the upper curve is a plot of the conductivity versus time of a washing liquor with a powder detergent, while the lower curve is a plot of the conductivity versus time of a washing liquor with a liquid detergent. In FIG. 5*b*, the generally upper curve is a plot of the turbidity of a washing liquor with a liquid detergent, while the lower curve is a plot of the turbidity versus time of a washing liquor with a powder detergent.

FIG. 5*a* shows that powder detergent is characterized by higher conductivity, since there is almost a factor of 10 between the two signals. Experimental tests performed by the Applicant have shown that conductivity signals of powder and liquid detergent do not superimpose even when high liquid amount is compared to small powder amount, so making this kind of measurements robust and reliable.

Analogously, on FIG. 5*b* the percentage of transmitted light as measured by turbidity sensor 200 is plotted: powders cause greater water opaqueness, increasing light scattering and absorbance. So less light reaches the receiver 220 and lower output is given. In this case difference between two signals is less evident, but provides an additional parameter to be compared to conductivity in order to avoid mismatch or reading failure.

It is important to underline these values, both referring to conductivity and turbidity, are scarcely affected by the specific brand of detergent (that is, different brands show similar pattern).

Preferably, the conductivity is measured calculating a difference between conductivity of tap water (coming to the washing machine 1 via mains) and one of washing liquor (mainly, water and detergent dissolved therein) due to the fact that the conductivity of the water in the mains can change quite relevantly from one location to another. Therefore, conductivity of pure water is to be taken as zero-level in order to evaluate the role of detergent in determining conductivity itself. On following paragraph, the term "conductivity" is to be meant as "difference between two conductivities measured: with detergent and the one of mains water".

It is not necessary to compare washing liquor turbidity to tap water one, since it is reasonable that mains water is almost totally pure.

Since powder detergent cause low optical transmittance (i.e. high turbidity) and high conductivity; while liquid detergent cause low optical absorbance (i.e. low turbidity) and low conductivity, both conductivity and turbidity signal can be compared to a specific threshold defined ad hoc in order to distinguish the type of detergent. One possible implementation of the algorithm is shown by the table reported below:

TABLE 1

| Type of detergent | Conductivity | Optical Transmittance |
|---|---|---|
| Liquid | LOW | HIGH |
| Powder | HIGH | LOW |

where "low" and "high" have the meaning of "below threshold" and "above threshold".

Conductivity could be evaluated only on part of washing cycle, e.g. analyzing initial peak (clearly distinguishable at minute 1-2 on plot of FIG. 5*a*). This could be done in two different ways:

analyzing graph slope over 1-2 minutes after initial peak (that is, conductivity variation over time, whose absolute value is greater when dealing with powder detergent). For example, on said plot after initial peak powder conductivity changes from c.a. 7 mS to c.a. 2 mS in about 90 s (55 μS/s on average), while liquid one ranges on average only of c.a. 8 μS/s (from 1250 to 500 on 90 s). These orders of magnitude are scarcely dependent on the specific brand of detergent taken into account.

analyzing the maximum value of the peak, that is the point where difference between conductivities is maximum. For example, on said plot maximum value for powder detergent is above seven thousand, while liquid detergent gives a maximum conductivity between one and two thousands. These orders of magnitude are scarcely dependent on the specific brand of detergent taken into account.

Such differences on conductivity and turbidity signals between liquid and powder detergents are due to their composition. At first, powder detergents contain great amounts of fillers, builders and alkali: zeolites are one of main components which do increase turbidity; on the other hand, zeolites aren't part of liquid detergents' composition.

Carbonate, sulphate and silicate salts are responsible for high conductivity in powder.

Combined use of turbidity and conductivity sensors prevents the measurements to be affected by water pollution from load high soiling levels and/or load pigments dissolution in water. Using only one sensor (e.g. turbidimeter) could imply in some circumstances that high soiling levels may lead to misleading results: particulate dirt cause high turbidity levels, which may refer to powder detergent. Since particulate dirt scarcely affects conductibility, the presence of powder detergent is excluded and the final feedback could be liquid detergent plus high level of particulate soil. As above mentioned, such problem would be solved using the combination of two said sensors.

Similarly, some specific types of dirt may increase water conductivity even without affecting turbidity: simplest case is sweat. This may cause water to get high conductivity levels, even if liquid detergent is used. In this case turbidimetric analysis is supposed to avoid detergent wrong recognition.

Therefore, according to the phase above described, the type of detergent—either liquid or powder—is determined automatically by the washing machine 1 using two sensors 200 and 500. The output of those sensors is sent to the control unit 50 which calculates, for example using a suitable software, the type of detergent present in the washing chamber. Any other method to determine the detergent's type can be used as well in phase 24.

In dependency of such determination, the method of the invention selects and adjusts the further phases. If it is determined that the detergent is of a first type, e.g. it is a liquid or gel detergent, as checked in phase 25, then a temperature check phase takes place, phase 26. If the detergent is not of a first type, for example it is a detergent in a powder form, then no action is required and the washing program can continue unmodified (phase 27), in particular the default washing temperature is unchanged.

Figure 2:
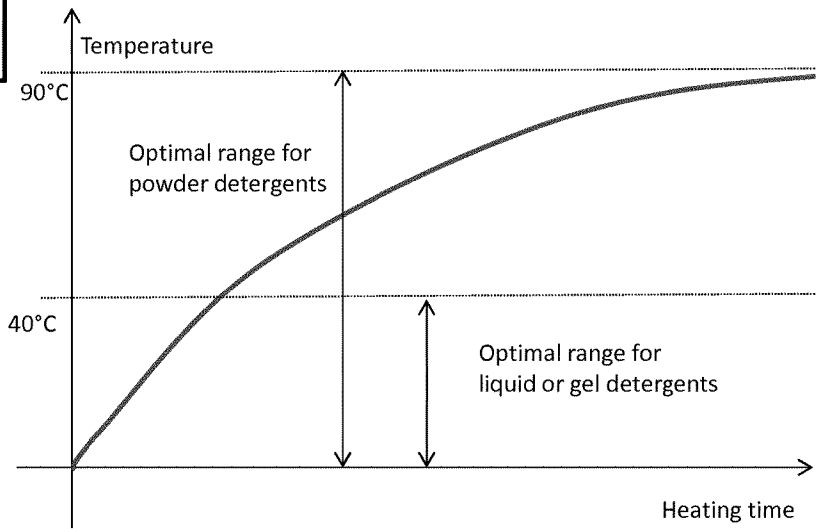
FIG. 2 is a graph showing the optimal temperature for liquid or powder detergents.

As shown in FIG. 2, the liquid or gel detergents are optimized for working in water at a temperature below or equal to 40° C. Therefore, if the detergent used is for example liquid or in gel form, a default washing temperature higher than 40° C. should preferably be avoided. For detergents in powder form, all temperatures are suitable, i.e. temperatures from 0° C. to 90° C.

In the temperature checking phase 26, it is checked whether the default temperature selected either by the user or by the program itself is above or below a certain threshold. The threshold is memorized in a memory (not visible in the appended drawings) included in the washing appliance 1. In this example, the threshold is equal to 40° C., being the detected detergent a detergent in liquid form. However, the value of the threshold can be washing program dependent and also detergent's type dependent. If the default temperature is below the memorized threshold, then again no action is required and the washing program continues unmodified and unchanged. In particular, the washing temperature remains the default washing temperature (phase 28). Alternatively, if the default washing temperature lies below the threshold temperature (e.g. the user has selected a 90° cotton program using liquid detergent), then action is taken by the appliance 1.

As depicted in phase 29, this "action" phase may include either:

A. Warning the user by means of any warning device, for example making one of the light elements 14 blinking;

B. Changing the default washing temperature to a temperature below or equal to the threshold temperature;

C. As in B, but in addition warning the user of the change, substantially as in A.

In this phase 29, therefore, the default temperature is changed to a value below or equal the changes the threshold, and/or the user is warned of the mismatch.

Figure 6:
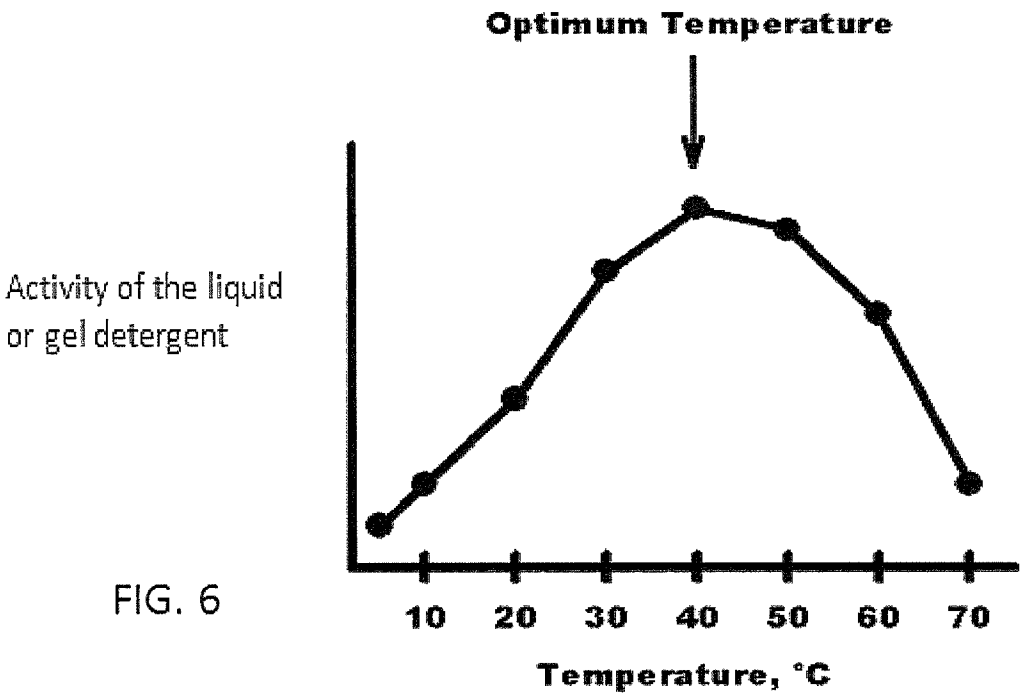
FIG. 6 is a graph showing the optimal temperature for a liquid or a gel detergent.

As shown in FIG. 6, the threshold temperature of 40° C. represents the temperature at which liquid or gel detergents have their peak of activity. Therefore, in a preferred embodiment, if a temperature higher than such a peak temperature=threshold temperature is the selected default temperature, by the method of the invention the temperature is changed back to the optimal peak temperature.

In some embodiments, the user is either allowed to change the temperature again following the advice of the washing appliance, or stick with the original selected high default washing temperature.

The invention claimed is:

1. A method for operating a laundry washing appliance having a washing chamber to wash goods, said method including:

selecting a default washing temperature or a washing program having a default washing temperature;

supplying a detergent to the washing chamber;

detecting, by a sensor, a physical property of the detergent;

determining a type of said detergent which has been added based on the physical property of the detergent detected by the sensor;

wherein, in case said detergent is determined to be a first type including a deterrent in liquid or gel form, the method includes:

comparing said default washing temperature with a threshold temperature; and when said default washing temperature is higher than said threshold temperature, emitting a warning signal or changing said default washing temperature.

2. The method according to claim 1, wherein said changing said default temperature includes:

lowering said default washing temperature to a reference temperature.

3. The method according to claim 2, wherein said reference temperature is identical to said threshold temperature.

4. The method according to claim 1, wherein emitting a warning signal includes:

emitting a visual or acoustic signal indicating that the default washing temperature is too high.

5. The method according to claim 1, wherein, after emitting said warning signal, the method includes allowing a user to modify said default washing temperature or said washing program.

6. The method according to claim 1, wherein, after changing said default washing temperature, the method includes:

allowing a user to modify the changed temperature.

7. The method according to claim 1, wherein, in ease said detergent is of a second type, the method includes leaving the default washing temperature or washing cycle unmodified.

8. The method according to claim 7, wherein said detergent of the second type is a detergent in powder form.

9. The method according to claim 1, wherein determining the type of said detergent includes:

measuring the conductivity of a washing liquid present in said washing chamber.

10. The method according to claim 9, wherein said measuring the conductivity of the washing liquid includes:

determining the rate of change in conductivity caused by dissolution of said detergent in said washing liquid.

11. The method according to claim 1, including:

measuring the turbidity of a washing liquid present in said washing chamber.

12. The method according to claim 11, wherein measuring the turbidity of a washing liquid present in said washing chamber includes:

determining the rate of change in turbidity caused by dissolution of said detergent in said washing liquid.

13. The method according to claim 9, wherein determining the type of said detergent includes:

measuring the conductivity of a washing liquid present in said washing chamber; and measuring the turbidity of a washing liquid present in said washing chamber; and determining that said detergent is a liquid or gel detergent when said conductivity is below a conductivity threshold and said turbidity is below a turbidity threshold; or determining that said detergent is a powder detergent when said conductivity is above a conductivity threshold and said turbidity is above a turbidity threshold.

14. The method according to claim 1, wherein determining the type of said detergent includes:

selecting the type of detergent among a list of possible detergent types.

15. The method according to claim 1, wherein said threshold temperature depends on said selected washing program.

16. The method according to claim 1, wherein selecting a default washing temperature or a washing program having a default washing temperature includes:

automatically selecting a washing program on the basis of one or more parameters of said goods.

17. A washing appliance including:

a washing chamber to wash laundry apt to rotate around an axis;

a control panel including one or more selection devices apt to select a default washing temperature or a washing program having a default washing temperature to wash laundry inside said washing chamber;

a sensor configured to detect a physical property of a detergent in the washing chamber; and a control unit in communication with said sensor and said control panel, said control unit configured to:

determine a type of the detergent in said washing chamber based on the physical property of the detergent detected by the sensor, and in response to determining that the type of detergent is a liquid or a gel, check whether said default washing temperature is higher than a given threshold, and send a warning signal or change said default washing temperature when said default washing temperature is higher than said threshold.

18. The washing appliance according to claim 17, wherein said sensor is located within said washing chamber.

19. The washing appliance according to claim 17, including a recirculating water circuit and said sensor is located within said circuit.

20. The washing appliance according claim 17, wherein said sensor includes a conductivity sensor.

21. The washing appliance according to claim 17, wherein said sensor includes a turbidity sensor.

22. The washing appliance according to claim 17, wherein said washing appliance is a washing machine or a washer-dryer.

23. The washing appliance according to claim 17, including a warning device connected to said control unit apt to warn a user when said default washing temperature is higher than a given threshold.

24. The washing appliance according to claim 17, wherein said control unit is apt to modify said default washing temperature.

* * * * *